US008939204B2

(12) United States Patent
McGarian

(10) Patent No.: US 8,939,204 B2
(45) Date of Patent: Jan. 27, 2015

(54) METHOD AND APPARATUS FOR COMMUNICATING WITH A DEVICE LOCATED IN A BOREHOLE

(75) Inventor: Bruce McGarian, Stonehaven (GB)

(73) Assignee: Halliburton Manufacturing and Services Limited (GB)

( * ) Notice: Subject to any disclaimer, the term of this patent is extended or adjusted under 35 U.S.C. 154(b) by 415 days.

(21) Appl. No.: 13/394,733

(22) PCT Filed: Sep. 9, 2010

(86) PCT No.: PCT/GB2010/051503

§ 371 (c)(1),
(2), (4) Date: Apr. 20, 2012

(87) PCT Pub. No.: WO2011/036471

PCT Pub. Date: Mar. 31, 2011

(65) Prior Publication Data

US 2012/0199344 A1 Aug. 9, 2012

(30) Foreign Application Priority Data

Sep. 24, 2009 (GB) ..... 0916808.9
Sep. 28, 2009 (GB) ..... 0916964.0

(51) Int. Cl.
*E21B 47/22* (2012.01)
*E21B 7/06* (2006.01)
(Continued)

(52) U.S. Cl.
CPC ..... *E21B 7/061* (2013.01); *E21B 29/06* (2013.01); *E21B 47/185* (2013.01); *E21B 47/187* (2013.01)
USPC ..... 166/250.01; 166/250.11; 175/40

(58) Field of Classification Search
USPC ..... 166/250.01, 250.11; 175/40; 367/83, 95
See application file for complete search history.

(56) References Cited

U.S. PATENT DOCUMENTS 4,351,037 A 9/1982 Scherbatskoy
4,491,738 A 1/1985 Kamp
4,715,022 A * 12/1987 Yeo ..... 367/83
2002/0124652 A1 9/2002 Schultz

FOREIGN PATENT DOCUMENTS

EP 2391793 A2 12/2011
GB 2120433 11/1983

(Continued)

OTHER PUBLICATIONS

UK Search report, Corresponding App. GB 0916808.9; 4 pages; Jan. 15, 2010.

(Continued)

*Primary Examiner* — Cathleen Hutchins
(74) *Attorney, Agent, or Firm* — McDermott Will & Emery LLP; Alan Bryson

(57) ABSTRACT

A method of communication comprising: providing a string of a plurality of connected components (2,3,5,6,7), one or more vessels running along the string to form a continuous fluid path (13); incorporating a device (3) into the string so that the device is in communication with the fluid path; inserting the string into a borehole (18) so that the device is located below a surface into which the borehole is formed and the fluid path extends from the surface to the device; providing a pressure sensor at the surface, adapted to sense the pressure of the fluid in the fluid path; filling it with a pressurized fluid; over a communication period, venting fluid, under the control of the device, from the fluid path (13) to an exterior of the string (17) at the device on occasions, so that the resulting decrease in pressure in the fluid in the fluid path can be detected by the pressure sensor; and during the communication period introducing fluid into the fluid path at a rate below 30 gallons/minute [0.113 m3/minute].

8 Claims, 1 Drawing Sheet

Figure 1:
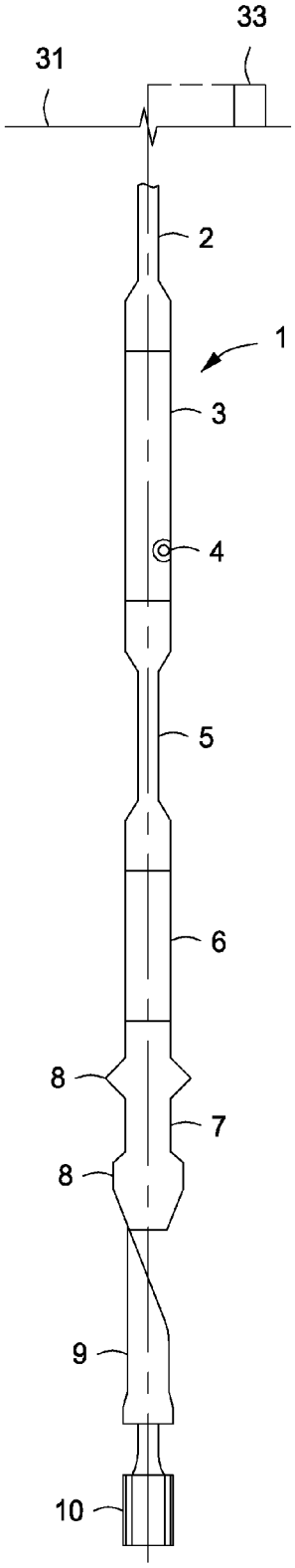

(51) Int. Cl.
*E21B 29/06* (2006.01)
*E21B 47/18* (2012.01)

(56) References Cited

FOREIGN PATENT DOCUMENTS

| | | |
|---|---|---|
| GB | 2164682 | 3/1986 |
| WO | 02/059461 | 8/2002 |
| WO | 2010086634 A2 | 8/2010 |

OTHER PUBLICATIONS

UK Search report, Corresponding App. GB 0916964.0; 5 pages; Feb. 5, 2010.

Official Communication for European Patent Application No. 12 173 378.6 dated Nov. 21, 2014.

* cited by examiner

METHOD AND APPARATUS FOR COMMUNICATING WITH A DEVICE LOCATED IN A BOREHOLE

THIS INVENTION relates to a method and device for communicating with a device located in a borehole, and in particular for communication of a parameter measured by the device to operators at the surface.

Whipstocks have been used in the development of oil and gas wells for many years, to divert the course of an existing well bore. This may be required to avoid a blockage or obstacle in an existing well bore, such as a stuck drill string or to branch off a new well bore (known as a "sidetrack") to reach another geological target. As will be understood in the art, a whipstock generally comprises an elongate body having a tapering face. At an upper end of the body, the face provides little or no obstruction to the well bore. At a lower end of the whipstock, the body substantially fully obstructs the well bore, and the tapered face provides a gradual transition between the upper and lower ends.

If a whipstock is fixed in place in a well bore, and a milling head is driven downwardly through the well bore, the tapered face will drive the milling head sideways through the casing of the well bore to begin milling into the formation adjacent the well bore, to begin the creation of the sidetrack.

Clearly, before fixing or anchoring a whipstock in place, it is important to know the rotational orientation of the whipstock with respect to the well bore, to ensure that the sidetrack will be formed branching off from the existing well bore in the correct direction. Once a whipstock has been run into a well bore as part of a drill string, the orientation of the whipstock is typically measured using a measurement while drilling (MWD) or gyro tool which is incorporated into the drill string.

Conventionally, once the whipstock reaches the appropriate depth, drilling fluid is circulated through the drill string. The drill string will typically include a series of interconnected vessels which form an enclosed fluid flow path running down the length of the drill string. Fluid is pumped into this flow path and, at one or more points along the length of the drill string, exits the fluid path into the annulus (i.e. the space within the well bore surrounding the components of the drill string). The well bore will typically already be full of fluid, so the venting of pressurised drilling fluid into the annulus causes fluid to rise out of the well bore at the surface at substantially the same rate that it is pumped into the drill string. This fluid can be captured, cleaned and/or filtered as necessary, and reintroduced under pressure into the drill string. This cycling of fluid is known as circulation.

MWD tools fall into three major categories. Positive pressure tools apply a temporary restriction to the flow of fluid through the drill string, leading to increased pressure in the drill string above the restriction. This increased pressure can be sent by a pressure transducer, or other suitable sensor, which is in fluid communication with the upper part of the drill string, or with the annulus.

Negative pressure tools temporarily open an additional flow path to the annulus, allowing fluid to flow more freely through the drill string and thus temporarily reducing the pressure of fluid in the drill string. Once again this can be detected by the pressure sensor.

Finally, continuous wave (or "siren") tools apply a continuous cyclical pressure variation to the fluid in the drill string and this may be achieved, for example, by providing two closely-spaced rotors, one of which rotates with respect to the other. The cycling rate can be varied to encode a signal (i.e. through frequency modulation) which can then be detected by the pressure sensor.

These techniques are examples of mud pulse telemetry.

It is an object of the present invention to provide an improved communication system between a downhole tool and operators at the surface of a well bore.

Accordingly, one aspect of the present invention provides A method of communication between a device located in a borehole and a remote sensor, comprising the steps of: providing a string of a plurality of connected components, one or more vessels running along the string to form a continuous, substantially enclosed fluid path; incorporating a device into the string so that the device is in communication with the fluid path; inserting the string into a borehole so that the device is located below a surface into which the borehole is formed and the fluid path extends from the surface to the device; providing a pressure sensor at or near the surface, the pressure sensor being adapted to sense the pressure of the fluid in the fluid path; substantially filling the fluid path with a pressurised fluid; over a communication period, venting fluid, under the control of the device, from the fluid path to an exterior of the string at or near the device on one or more occasions, so that the resulting decrease in pressure in the fluid in the fluid path can be detected by the pressure sensor; and during the communication period introducing fluid into the fluid path at a rate below 30 gallons/minute [0.113 $m^3$/minute].

Advantageously, during the communication period, fluid is not introduced into the fluid path.

Preferably, the method further comprises the step of measuring a parameter using the device, and wherein the measured parameter is encoded into the venting of fluid from the fluid path, so that the parameter can be derived from measurements taken by the pressure sensor.

Conveniently, two discrete ventings of fluid are effected to encode the measurement, with the length of time between the ventings being representative of the size of the measured parameter.

Advantageously, a venting of fluid of a controlled length is effected to encode the measurement, with the duration of the venting being representative of the size of the measured parameter.

Another aspect of the present invention provides a method of communication between a device located in a borehole and a remote sensor, comprising the steps of: providing a string of a plurality of connected components, one or more vessels running along the string to form a continuous, substantially enclosed fluid path; incorporating a device into the string so that the device is in communication with the fluid path; inserting the string into a borehole so that the device is located below a surface into which the borehole is formed and the fluid path extends from the surface to the device; substantially filling the fluid path with a pressurised fluid; providing a pressure sensor at or near the surface, the pressure sensor being adapted to sense the pressure of the fluid in the fluid path; over a communication period, restricting the flow of fluid through the fluid path at or near the device so that the resulting increase in pressure in the fluid in the fluid path can be detected by the pressure sensor; and during the communication period, introducing fluid into the fluid path at a rate below 100 gallons/minute [0.379 $m^3$/minute].

A further aspect of the present invention provides a method of communication between a device located in a borehole and a remote sensor, comprising the steps of: providing a drill string comprising a plurality of connected components, one or more vessels running along the drill string to form a continuous fluid path; incorporating a device into the drill string so that the device is in communication with the fluid path; inserting the drill string into a borehole so that the device is located below a surface into which the borehole is formed and the fluid path extends from the surface to the device; substantially filling the fluid path with a pressurised fluid; circulating fluid through the fluid path and through the device, so that the majority of the fluid leaves the fluid path and passes into the surrounding wellbore through an exit aperture formed below the device; providing a pressure sensor at or near the surface, the pressure sensor being adapted to sense the pressure of the fluid in the fluid path; over a communication period, restricting the flow of fluid through the fluid path at or near the device so that the resulting increase in pressure in the fluid in the fluid path can be detected by the pressure sensor; and following the communication period, commencing a milling or drilling operation using a milling or drilling arrangement provided as part of the drill string, wherein the exit aperture is left open during the milling or drilling operation.

Preferably, during the communication period, fluid is introduced into the fluid path at a rate below 100 gallons/minute [0.379 $m^3$/minute].

Conveniently, the method further comprises the step of measuring a parameter using the device, and wherein the measured parameter is encoded into the venting of fluid from the fluid path, so that the parameter can be derived from measurements taken by the pressure sensor.

Figure 2:
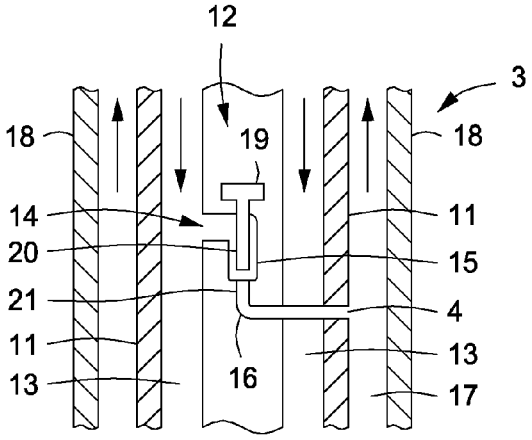
Figure 3:
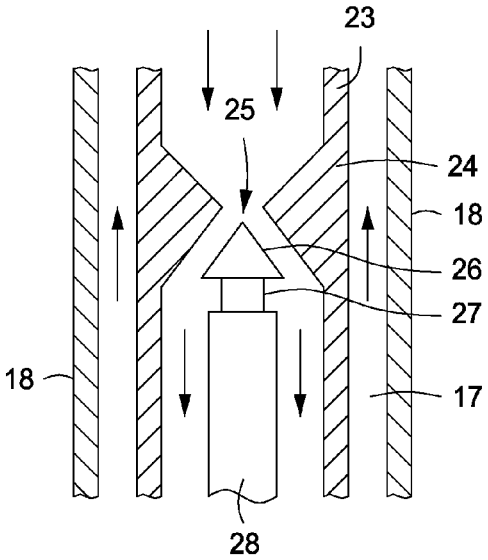

In order that the present invention may be more readily understood embodiments thereof will now be described, by way of example, with reference to the accompanying drawings, in which:

FIG. 1 is a schematic representation of components of a drill string suitable for use with the present invention; and FIGS. 2 and 3 are schematic representations of parts of measurement tools suitable for use with the present invention.

With reference firstly to FIG. 1, a drill string 1 suitable for use with the present invention is shown. The drill string 1 is intended to be run into a bore hole (not shown), and the widest part of the drill string will fit into the bore hole with a relatively close fit.

At an upper end of the drill string 1 is a connection pipe 2 which provides a connection between the drill string 1 and the surface. It will be understood that, in use, the drill string 1 may be positioned at a considerable depth (for instance, several thousand feet) beneath the surface, and there may therefore be a relatively large number of pipes and/or other components positioned between the drill string 1 and the surface.

Beneath the connection pipe 2 is a measurement tool 3, which in the depicted embodiment is a conventional negative pressure MWD tool, which will be described in greater detail below. The measurement tool 3 has a bleed port 4 formed in an outer surface thereof, allowing communication between the fluid path of the drill string 1 and the surrounding well bore.

Positioned beneath the measurement tool 3 is a flex joint 5, which may flex and/or deflect. The flex joint 5 is to provide the milling arrangement (described below) with the latitude to move or traverse the tapered face of the whipstock without milling into it, and hence to minimise the damage caused to the whipstock by the milling arrangement.

Beneath the flex joint 5 is a hydraulic barrier 6, which will be described in more detail below.

Beneath the hydraulic barrier 6 is a milling assembly 7, which comprises one or more milling heads 8. The milling heads 8 are provided for milling through the casing of the borehole, and/or for milling into the formation surrounding the borehole to form a sidetrack.

Connected to the lower end of the milling assembly 7 is a whipstock 9, as discussed above.

Connected to the lower end of the whipstock 9 is a setting device 10 which, once activated engages the casing of the borehole to lock itself in place in the borehole. The setting device 10 may take the form of an anchor or packer, as is well known in the art, and in preferred embodiments is set hydraulically.

As discussed above one or more fluid-tight vessels run along the length of the drill string 1 and form a generally fluid-tight, enclosed fluid path that flows through the connection pipe 2 from the surface, through each of the components of the drill string 1 to the setting device 10.

A schematic cut-away view of part of the measurement tool 3 is shown in FIG. 2. The measurement tool 3 has a generally cylindrical outer wall 11, and an internal core 12 which is disposed within the outer wall 11. An approximately annular gap 13 exists between the outer wall 11 and the core 12, and as fluid flows through the fluid path of the drill string 1 the fluid passes along this annular gap 13.

An inlet aperture 14 is formed on an outer surface of the core 12, allowing fluid to flow into a chamber 15 within the core 12. At a lower end of the chamber 15 is an outlet conduit 16, which is narrower in diameter than the chamber 15. The outlet conduit 16 passes out through a side of the core 12, crosses the annular gap 13 and connects to the annulus 17 (the casing of the bore hole is indicated by reference numeral 18 in FIG. 2).

A blocking member 19 is slidably mounted within the core 12, and has a closure member 20 which projects into the chamber 12. The blocking member 19 has an open position, as shown in FIG. 2, in which the entrance 21 to the outlet conduit 16 is unblocked, and so fluid may flow from the chamber 15, through the outlet conduit 16 and to the annulus 17. The blocking member 19 may also move to a closed position, in which the closure member covers and blocks the entrance 21 to the outlet conduit 16, so that the chamber 15 presents a "dead end" to fluid.

Movement of the blocking member 19 may be controlled, for instance, by one or more servo motors or solenoids.

The measurement tool 3 has measurement equipment (not shown) mounted in a body thereof, and is able to measure parameters of its environment, for instance the rotational orientation of the tool 3, and/or the inclination (with respect to vertical) of the tool 3. The movement of the blocking member 19 is also controlled by a processor of the measurement tool 3.

As described above the setting device 10 is, in preferred embodiments of the invention, adapted to be set hydraulically, by the fluid in the drill string being raised above a threshold pressure. This pressure may be, for example, around 1000 psi [6.9 MPa].

Returning to the hydraulic barrier 6, the barrier 6 is of a known type, having a floating piston therein separating the fluid above the barrier 6 from the fluid below the barrier 6. A "clean" fluid is provided below the barrier 6, such as water or oil. Drilling fluid will be present above the piston and, as will be understood, the drilling fluid may contain mud, debris and other impurities. As the pressure of the fluid in the drill string 1 is increased to set the setting device 10, the presence of the fluid barrier ensures that the setting device is set with the clean fluid.

In an embodiment one or more of the milling heads 8 may have circulation ports (not shown) formed therein, which allow, when opened, fluid to exit the drill string 1 through the circulation ports to the annulus. However, in an initial state, the ports are blocked, for instance by plugs which are adapted to be mechanically broken through rotation of the milling heads 8, thus opening the circulation ports.

Use of the drill string shown in FIG. 1 will now be described.

Firstly, the drill string 1 is run into a well bore so that the whipstock 9 is at a desired depth within the well bore. As the drill string 1 is run into the well bore fluid is introduced into the drill string 1 so that, when the whipstock 9 reaches the desired depth, the drill string 1 is full, or substantially full, of fluid. The fluid is placed under a predetermined pressure, for instance 500 to 600 psi [3.45 to 4.14 MPa].

The measurement tool 3 is, in an embodiment, configured to be activated once the pressure of the fluid in the drill string 1 rises above a certain level, for instance 500 psi [3.45 Mpa]. A skilled person will appreciate that this may readily be achieved, for instance, through use of an appropriate pressure sensor within the measurement tool 3.

Once the measurement tool 3 has been activated, it will begin to take measurements of one or more desired parameters. Once a measurement has been taken, for instance of the rotational orientation of the measurement tool 3, this measurement can be communicated to the surface.

The measurement tool 3 communicates the measurements through selectively moving the blocking member 19, thus allowing fluid to be vented from the measurement tool 3 through the bleed port 4. It will be understood that, at this stage, there is no circulation of fluid through the drill string 1, and the fluid in the drill string 1 is in a substantially static, pressurised state. Therefore, when the blocking member 19 is moved to the open position, this will allow a quantity of the fluid in the drill string 1 to be vented to the annulus 17, thus reducing fluid pressure in the drill string 1. This drop in fluid pressure can be detected by any suitable sensor 33, which measures the pressure in the drill string fluid at or near the surface 31.

In an embodiment no fluid is introduced into the fluid path of the drill string 1 at this stage of the process. Therefore, it will be desirable to vent only a relatively small amount of fluid to the annulus through the bleed port 4.

In one embodiment a measurement is communicated by briefly venting fluid through the bleed port 4 on two separate occasions, with the length of time between the openings of the bleed port 4 being proportional to (or otherwise indicative of) the size of the measured parameter. The fluid pressure in the drill pipe may be set at 600 psi [4.14 Mpa] initially, and each of the brief openings of the bleed port 4 may, for example, reduce the pressure by around 5 psi [0.035 Mpa]. The reductions will be readily detectable at the surface, and the communication of the measurement will therefore only reduce the pressure by around 10 psi [0.069 Mpa].

In other embodiments fluid may be vented to the annulus 17 in a longer burst, with the length of the burst being proportional to (or otherwise indicative of) the size of the measured parameter.

Advantageously, as the measurement tool 3 is communicating a measurement to the surface, the measurement tool 3 is also taking, or preparing to take, a further measurement, to be transmitted to the surface in the same way. The measurement tool 3 therefore transmits a sequence of measurements during this part of the process.

In preferred embodiments the measurement tool 3 will continue to take and communicate measurements in this way until the pressure drops below a threshold level—this threshold level may be the same as the level at which the tool is activated, but in preferred embodiments may be lower, for instance 200 psi [1.38 Mpa]. At this point, the measurement tool 3 will be deactivated. Operators at the surface may choose to introduce further fluid into the drill string, to raise the pressure in the drill string above the threshold once again so that a new set of measurements can be taken and communicated.

Once operators at the surface are satisfied that the whipstock is correctly oriented, the pressure in the drill string is raised above the threshold at which the settable device 10 is set. The settable device 10 will then lock itself in place with respect to the bore hole, for instance, by the activation of one or more slips which will dig into the casing of the bore hole. The drill string 1 is then moved upwardly or downwardly to break the connection between the milling arrangement 7 and the top of the whipstock 9.

Rotation of the milling heads 8 then begins, which (as described above) breaks the plugs and opens the circulation ports in the milling heads 8, so that a continuous circulation of drilling fluid through the ports is established. The drill string 1 is then allowed to descend through the bore hole so that the milling heads 8 are deflected off the tapered face of the whipstock 9 to begin milling through the casing of the bore hole. It will be appreciated that, if the measurement tool 3 is a conventional MWD tool (as is the case in the above description) then it may be possible to revert to a more normal communication protocol so that the measurement tool 3 can continue to communicate with the surface during the milling process. Alternatively, it may be necessary for the measurement tool 3 be provided with one or more nozzles or other internal components that are narrowed compared to those of standard tools, to allow sufficiently small volumes of fluid to be vented to the annulus during the communication processes described above, and this may prevent the tool 3 from being able to communicate effectively during the milling or drilling process.

It should also be noted that, in any event, once the milling arrangement 7 has been disconnected from the whipstock 9, it will generally not be possible to obtain useful readings from the tool 3 until the tool 3 has exited the well bore and is within the surrounding formation, due to the proximity of the tool 3 to the casing of the well bore.

As the pressure and flow rate in the drill string 1 increase, the floating piston is driven into an end stop position, in which it can be bypassed by fluid flowing through the barrier 6, so it does not provide any obstacle to circulation of drilling fluid during the milling/drilling operation.

In conventional arrangements a separate bypass valve or fluid flow path needs to be provided below the measurement tool and above the milling arrangement, to provide a port from the drill string to the annulus and therefore allow circulation to the annulus to be established so that the measurement tool can communicate measurements to the surface. Once the measurement tool is correctly oriented the bypass valve is closed, to prevent fluid exiting the drill string to the annulus at the valve, and to allow drilling fluid to be diverted to the milling arrangement 7.

However, it will be appreciated that, using the above system, this bypass valve is not required, and can be omitted from the drill string. This saves weight and expense, allows a simpler overall system, and also removes one component which may potentially fail. Using the above described system also allows the circulation pumps to be switched on at a later stage, thus saving energy.

In the above description it is stated that no fluid is introduced into the drill string 1 while measurements are communicated by the measurement tool 3. Indeed, this is preferred, as introduction of fluid into the drill string 1 will raise the pressure of the fluid in the drill string 1, thus potentially obscuring the measurement of the drops in fluid pressure caused by the ventings of fluid through the bleed port 4.

However, in other embodiments fluid may be introduced into the drill string, although at a rate much lower than that normally employed in the circulation of drilling fluid. For instance, fluid may be introduced at a rate of 30 gallons per minute (0.114 $m^3$ per minute) or less.

The above description relates to "negative pressure" communication. It should be noted, however, that conventional negative pressure communication generally involves a substantially constant fluid pressure, which temporarily drops before returning to its previous level. By contrast, communication using the methods described above involves successive reductions in pressure, so that over the period of communication the pressure falls progressively over time. Embodiments of the invention are also possible in which positive pressure is used.

FIG. 3 shows a schematic cut-away view of part of an alternative measurement tool 22, which could be incorporated into the drill string 1 in place of the measurement tool 3 described above.

The alternative drilling tool has an outer wall 23 which defines a flow path through the tool 22. An inwardly projecting lip 24, having a generally triangular cross-section, runs around the inner surface of the outer wall 24, defining a central gap 25 through which fluid is channelled.

A plug member 26, which has a generally conical form, is provided downstream of the central gap 25, and is generally aligned therewith. The plug member is mounted on an extendable support 27, which is generally coaxial with the tool 22 and which may be extended into, or retracted from, a housing 28. In an open position, shown in FIG. 3, the plug member 26 is spaced apart from the central gap 25, and so fluid may flow freely through the central gap 25 and past the plug member 26 as it flows through the tool 22.

In a closed position, the extendable support 27 is extended from the housing 28 so that it obstructs, fully or partially, the central gap 25.

In these embodiments a relatively small exit aperture (not shown), allowing communication between the drill string 1 and the annulus 17, is provided at some point in the drill string 1 below the central gap 25 of the measurement tool 22. This exit aperture may be provided at or near a lower end of the measurement tool 22, in one of the other components already described above and located below the measurement tool 22, or indeed in a new component which is inserted into the drill string 1.

To communicate using positive pressure, some flow of fluid in the drill string 1, passing through the measurement tool 22 and out of the exit aperture, is required. However, the flow may be at a rate which is much less than that normally used for circulation of drilling fluid, i.e. around 50 to 100 gallons per minute (0.189 to 0.379 $m^3$ per minute), and preferably less than 80 gallons per minute (0.303 $m^3$ per minute). This flow rate will be sufficient for restrictions to the flow of fluid passing through the tool 22, caused by temporarily placing the plug member 26 in the closed position, to create an increase in pressure within the drill string 1 which can be detected by a pressure sensor at or near the surface.

Importantly, the size of the exit aperture may be small enough that, once the whipstock is correctly oriented and pressure in the drill string 1 needs to be increased to set the settable device 10 and begin the drilling process, the exit aperture can be left open and does not need to be blocked off. Preferably, the dimensions of the aperture are in the region of ⅜" [9.5 mm], also referred to as a size 12 nozzle in the industry.

It is anticipated that the size of the central gap 25 will be too small to allow effective circulation of fluid through the drill string 1 during a subsequent milling or drilling operation. It is therefore envisaged that a bypass arrangement will be required, to open a larger area through which fluid may flow as the milling or drilling operation proceeds. The skilled person will readily understand how this may be achieved.

Embodiments similar to that described above for communication via positive pressure may also be used for communication by a "siren" or continuous wave method, as discussed above.

It will be appreciated that embodiments of the present invention will allow effective communication between a measurement tool and the surface of a well bore, and that the need for a separate bypass valve can effectively be removed. Moreover, the invention allows existing well bore components to be modified, simply through re-programming or through modification of the controlling software/firmware, to effect communications with the surface in a more effective manner.

It will be appreciated that the order of the components in the drill string may deviate from that described above, and the invention is not limited to this order of components.

Although the description above refers to drill strings it will be appreciated that embodiments of the invention may be used with strings of downhole components that do not have a milling or drilling capability. One example is a casing string, which installs a casing into a newly-drilled bore in a formation. Another example is a string of components to set an anchor in a well bore. Coil tubing and plastic tubing may also be used with the invention. Any sequence of downhole components which need to communicate with the surface may utilise embodiments of the present invention.

The examples above also involve an anchor/packer which is set hydraulically. It should be understood, however, that the invention may be used with setting devices that are set by other means, for instance mechanically.

When used in this specification and claims, the terms "comprises" and "comprising" and variations thereof mean that the specified features, steps or integers are included. The terms are not to be interpreted to exclude the presence of other features, steps or components.

The features disclosed in the foregoing description, or the following claims, or the accompanying drawings, expressed in their specific forms or in terms of a means for performing the disclosed function, or a method or process for attaining the disclosed result, as appropriate, may, separately, or in any combination of such features, be utilised for realising the invention in diverse forms thereof.

The invention claimed is:

1. A method of communication between a device located in a borehole and a remote sensor, comprising the steps of:

providing a string of a plurality of connected components, one or more vessels running along the string to form a continuous, substantially enclosed fluid path;

incorporating a device into the string so that the device is in communication with the fluid path;

inserting the string into a borehole so that the device is located below a surface into which the borehole is formed and the fluid path extends from the surface to the device;

providing a pressure sensor at or near the surface, the pressure sensor being adapted to sense the pressure of the fluid in the fluid path;

substantially filling the fluid path with a pressurised fluid;

over a communication period, venting fluid, under the control of the device, from the fluid path to an exterior of the string at or near the device on one or more occasions, so that the resulting decrease in pressure in the fluid in the fluid path can be detected by the pressure sensor; and during the communication period introducing fluid into the fluid path at a rate below 30 gallons/minute [0.113 $m^3$/minute].

2. A method according to claim 1 wherein, during the communication period, fluid is not introduced into the fluid path.

3. A method according to claim 1 or 2, further comprising the step of measuring a parameter using the device, and wherein the measured parameter is encoded into the venting of fluid from the fluid path, so that the parameter can be derived from measurements taken by the pressure sensor.

4. A method according to claim 3, wherein two discrete ventings of fluid are effected to encode the measurement, with the length of time between the ventings being representative of the size of the measured parameter.

5. A method according to claim 3, wherein a venting of fluid of a controlled length is effected to encode the measurement, with the duration of the venting being representative of the size of the measured parameter.

6. A method of communication between a device located in a borehole and a remote sensor, comprising the steps of:

providing a string of a plurality of connected components, one or more vessels running along the string to form a continuous, substantially enclosed fluid path;

incorporating a device into the string so that the device is in communication with the fluid path;

inserting the string into a borehole so that the device is located below a surface into which the borehole is formed and the fluid path extends from the surface to the device;

substantially filling the fluid path with a pressurised fluid;

providing a pressure sensor at or near the surface, the pressure sensor being adapted to sense the pressure of the fluid in the fluid path;

over a communication period, restricting the flow of fluid through the fluid path at or near the device so that the resulting increase in pressure in the fluid in the fluid path can be detected by the pressure sensor; and during the communication period, introducing fluid into the fluid path at a rate below 30 gallons/minute [113 $m^3$ /minute].

7. A method of communication between a device located in a borehole and a remote sensor, comprising the steps of:

providing a drill string comprising a plurality of connected components, one or more vessels running along the drill string to form a continuous fluid path;

incorporating a device into the drill string so that the device is in communication with the fluid path;

inserting the drill string into a borehole so that the device is located below a surface into which the borehole is formed and the fluid path extends from the surface to the device;

substantially filling the fluid path with a pressurised fluid;

circulating fluid through the fluid path and through the device, so that the majority of the fluid leaves the fluid path and passes into the surrounding wellbore through an exit aperture formed below the device;

providing a pressure sensor at or near the surface, the pressure sensor being adapted to sense the pressure of the fluid in the fluid path;

over a communication period, restricting the flow of fluid through the fluid path at or near the device so that the resulting increase in pressure in the fluid in the fluid path can be detected by the pressure sensor;

during the communication period, introducing fluid into the fluid path at a rate below 30 gallons/minute [0.113 $m^3$/minute]; and following the communication period, commencing a milling or drilling operation using a milling or drilling arrangement provided as part of the drill string, wherein the exit aperture is left open during the milling or drilling operation.

8. A method according to any one of claims 6 or 7, further comprising the step of measuring a parameter using the device, and wherein the measured parameter is encoded into the venting of fluid from the fluid path, so that the parameter can be derived from measurements taken by the pressure sensor.

* * * * *